US006220831B1

(12) United States Patent
Shiokawa et al.

(10) Patent No.: US 6,220,831 B1
(45) Date of Patent: Apr. 24, 2001

(54) TURBOMOLECULAR PUMP

(75) Inventors: Atsushi Shiokawa, Tokyo; Matsutaro Miyamoto, Kanagawa-ken; Hiroshi Sobukawa, Kanagawa-ken; Toshiharu Nakazawa, Kanagawa-ken, all of (JP)

(73) Assignee: Ebara Corporation, Tokyo (JP)

( * ) Notice: Subject to any disclaimer, the term of this patent is extended or adjusted under 35 U.S.C. 154(b) by 0 days.

(21) Appl. No.: 09/133,331

(22) Filed: Aug. 13, 1998

(30) Foreign Application Priority Data

Aug. 15, 1997 (JP) ..... 9-235438

(51) Int. Cl.[7] ..... F04B 17/04
(52) U.S. Cl. ..... 417/423.4; 417/295
(58) Field of Search ..... 417/423.4, 423.1, 417/295, 901; 137/625.65, 625.67

(56) References Cited

U.S. PATENT DOCUMENTS 4,637,433 * 1/1987 Stoll ..... 137/625.65
4,873,833 * 10/1989 Pfeiffer et al. ..... 62/55.5
4,919,599 * 4/1990 Reich et al. ..... 417/423.4
4,926,648 * 5/1990 Okumura et al. ..... 62/55.5
5,166,566 * 11/1992 Bernhardt et al. ..... 310/90.5
5,354,172 * 10/1994 Schofield ..... 415/90
5,443,368 * 8/1995 Weeks et al. ..... 417/27

FOREIGN PATENT DOCUMENTS 0 332 107 9/1989 (EP) .
0 397 051 11/1990 (EP) .
8-68389 3/1996 (JP) .

OTHER PUBLICATIONS

Patent Abstracts of Japan; vol. 18, No. 249 (M–1604), May 12, 1994 & JP 06 033874 A (Ulvac Kuraio KK) *abstract*.

* cited by examiner

*Primary Examiner*—Henry C. Yuen
*Assistant Examiner*—Mahmoud Gimie
(74) *Attorney, Agent, or Firm*—Armstrong, Westerman, Hattori, McLeland & Naughton, LLP

(57) ABSTRACT

A turbomolecular pump comprising a rotor and a stator housed in a casing and forming an exhaust channel therebetween, and a suction port and a discharge port formed in the casing; wherein the turbomolecular pump has a valve body for opening and closing the suction port, the valve body is movable in an axial direction of the turbomolecular pump, a valve driving mechanism for driving the valve body via a valve body supporting member which extends through a throughhole formed in the rotor and/or the stator and magnetic bearing units for non-contactingly supporting the valve body supporting member within the throughhole, whereby a turbomolecular pump having a compact overall construction including valve units can be provided.

10 Claims, 6 Drawing Sheets

TURBOMOLECULAR PUMP

BACKGROUND OF THE INVENTION

The present invention relates to a turbomolecular pump which enables exhaust of a gas by interaction between rotary blades and stationary blades and/or a threaded rotor rotating at a high speed and a stator.

A general structure of a conventional turbomolecular pump is illustrated in FIG. 6. The conventional turbomolecular pump comprises a rotor R including a main shaft 10 and a rotary cylinder 12 fixed to the main shaft for rotating integrally therewith, a stator S including a fixed cylinder 14 surrounding the shaft 10, and a cylindrical casing 16 surrounding the rotary cylinder 12, which are assembled on a base B. A conductance adjusting valve 100 and a gate valve 110 are provided in the space between the turbomolecular pump and an apparatus A to be evacuated provided on the upstream side of the turbomolecular pump.

In the conventional turbomolecular pump as described above, however, driving mechanisms 101 and 111 for the individual valve units 100 and 110 are provided adjacent to the turbomolecular pump and in the proximity of the valves. This has posed a problem of scaling-up of the valve units and results in a larger overall structure of the turbomolecular pump including these valves. It is conceivable, on the other hand, to form the valve unit integrally with the turbomolecular pump, but this may lead to contamination of the apparatus to be evacuated by particles arising from the valve driving mechanism.

SUMMARY OF THE INVENTION

The present invention was made to solve the problem described above, and has its object the provision of a turbomolecular pump which has a compact overall construction including valve units, and which is able to prevent contamination by the valve driving mechanism.

To accomplish the above object, according to a first aspect the invention, a turbomolecular pump is provided which comprises a rotor and a stator housed in a casing and forming an exhaust channel therebetween, and a suction port and an exhaust port formed in said casing, wherein the turbomolecular pump has a valve body for opening and closing the suction port, the valve body is movable in an axial direction of the turbomolecular pump, a valve driving mechanism for driving the valve body via a valve body supporting member which extends through a throughhole formed in the rotor and/or the stator, and bearing units for supporting the valve body supporting member within the throughhole. This arrangement enables a compact construction of the entire pump apparatus including the valve unit, since the valve unit is integrally formed with the pump.

The said bearing unit comprises a magnetic bearing unit for non-contactingly supporting the valve body supporting member. This arrangement permits prevention of contamination by particles arising from the supporting mechanism while stably supporting the valve body, because the valve body is driven by the valve driving mechanism while being non-contactingly supported by the magnetic bearing units via the valve body supporting member.

According to a second aspect of the invention, in a turbomolecular pump according to the first aspect, the rotor is non-contactingly supported by a rotor magnetic bearing, and a screw thread sealing mechanism which inhibits gas flow into the rotor magnetic bearing is provided between the rotor and the stator. This makes it possible to prevent corrosive exhaust gas from flowing into the rotor magnetic bearing, thus preventing corrosion of these members, and hence achievement of a turbomolecular pump having high durability can be accomplished.

According to a third aspect of the invention in a turbomolecular pump according to the first aspect, a gas feeding channel for feeding an inert gas is provided at a prescribed position between the rotor and the stator for inhibiting a gas flow into the bearing units by the inert gas. This provides a turbomolecular pump which prevents a corrosive exhaust gas from flowing into the rotor magnetic bearing while maintaining an inert atmosphere around the rotor magnetic bearing and, hence, has high durability.

According to a fourth aspect of the invention, in a turbomolecular pump according to the first aspect, there is provided gas deposition preventing means which prevents deposition of gas components at a contact portion between the suction port and the valve body by heating the suction port and/or the valve body. This permits maintenance of air-tightness of the valve body, thus ensuring safe operation.

The above and other objects, features and advantages of the present invention will become more apparent from the following description when taken in conjunction with the accompanying drawings in which preferred embodiments of the present invention are shown by way of illustrative examples.

EMBODIMENT OF THE INVENTION

Figure 1:
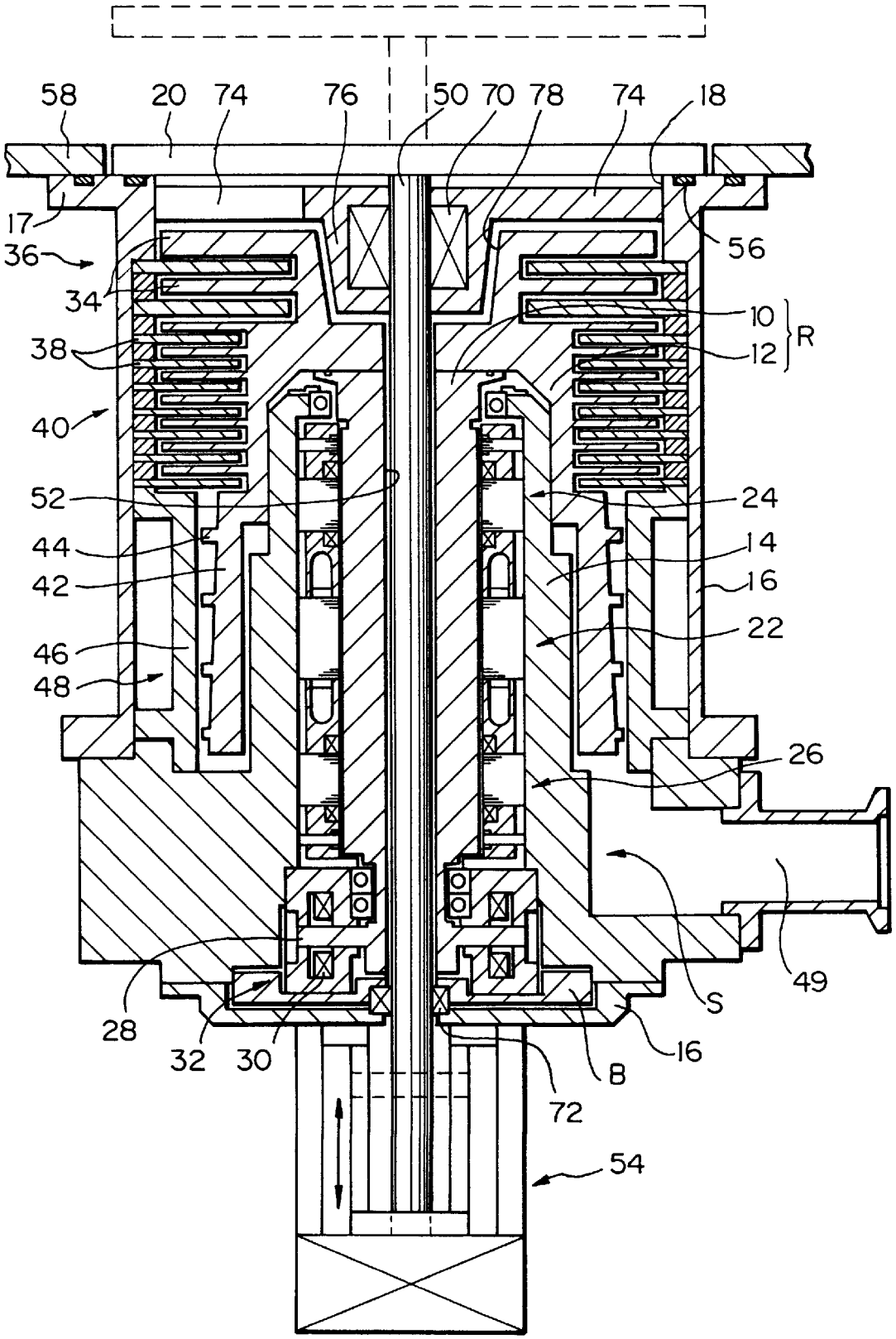
FIG. 1 is a sectional view illustrating a turbomolecular pump according to a first embodiment of the invention.

Preferred embodiments of the present invention will now be described with reference to the drawings. The turbomolecular pump according to a first embodiment of the invention is shown in FIG. 1, which comprises a rotor R including a main shaft 10 and a rotary cylinder 12 fixed to the main shaft for rotating integrally therewith, a stator S including a stationary cylinder 14 surrounding the main shaft 10, and a cylindrical casing 16 fixed to the stator S and surrounding the rotary cylinder 12, which are assembled on a base B. A disk shaped valve body 20 is provided at a suction port 18 of the casing 16 for opening and closing the suction port 18.

A driving motor 22 for rotating the rotor R at high speed is provided between the main shaft 10 and the stationary cylinder 14. An upper radial bearing 24 and a lower radial bearing 26 are provided on the upper and lower sides of the driving motor 22, respectively for non-contactingly supporting the rotor R. In the lower portion of the main shaft 10, a target disk 28 is provided at the lower end of the main shaft, and an axial bearing 32 including upper and lower coils 30 is provided on the stator S, so that the rotor R rotates at high speed under active control along 5 axis with driving of the driving motor 22.

Rotary blades 34 are formed integrally with the rotary cylinder 12 on the outer periphery of the upper portion thereof so as to form impellers 36. On the inner surface of the casing 16, on the other hand, stationary blades 38 are provided alternately with the rotary blades 34 with a spacer interposed therebetween. There is accordingly formed a blade exhaust portion 40 in which gas exhaust action is accomplished through interaction between the rotary blades 34 rotating at high speed and the stationary blades 38.

A screw thread portion 42 is provided on the rotary cylinder 12 so as to extend downwardly therefrom surrounding the outer periphery of the stationary cylinder 14, and screw thread 44 is provided on the outer peripheral surface of the screw thread portion 42. A spacer 46 surrounding the outer periphery of the screw thread portion 42 is provided on the stator S. As a result, a screw-thread exhaust portion 48 which performs gas exhaust action under drag action caused by the screw thread 44 of the screw thread portion 42 rotating at a high speed is provided between the blade exhaust portion 40 and an exhaust port 49.

A throughhole 52 for receiving a valve rod 50 of the valve body 20 is formed in the main shaft 10, the rotary cylinder 12 and the base B. An actuator 54 for driving the valve body 20 in the axial direction via the valve rod 50 is provided at the lower portion of the casing 16. A flange 17 of the casing 16 at the suction port 18 is provided with an O-ring 56 for air-tightly closing the suction port 18 by the valve body 20. A sealing mechanism (not shown) is provided at the connecting portion between the casing 16 and the actuator 54. The actuator 54 itself has an air tight structure.

The valve rod 50 is up and down movably supported by an upper and a lower magnetic radial bearings 70 and 72 provided in the suction port 18 and on the base B, respectively. The upper magnetic bearing 70 is supported by a supporting members 76 provided at inner ends of a plurality of arms 74 radially extending from inner surface of the casing 16 toward the center portion of the suction port 18. At the center portion of the suction port 18, a recess 78 is formed on the top surface of rotary cylinder 12 of the rotor R, and the supporting member 76 is accommodated in the recess 78.

In the embodiment shown, the valve rod 50 is stably supported by the upper and the lower magnetic bearings 70 and 72 so as to ensure smooth opening/closing of the valve body 20 without causing positional shift thereof. Because the magnetic bearings 70 and 72 can non-contactingly support the valve rod 50, particles are hardly generated by friction, and, thus, the apparatus to be evacuated is not contaminated by the particles.

Figure 4:
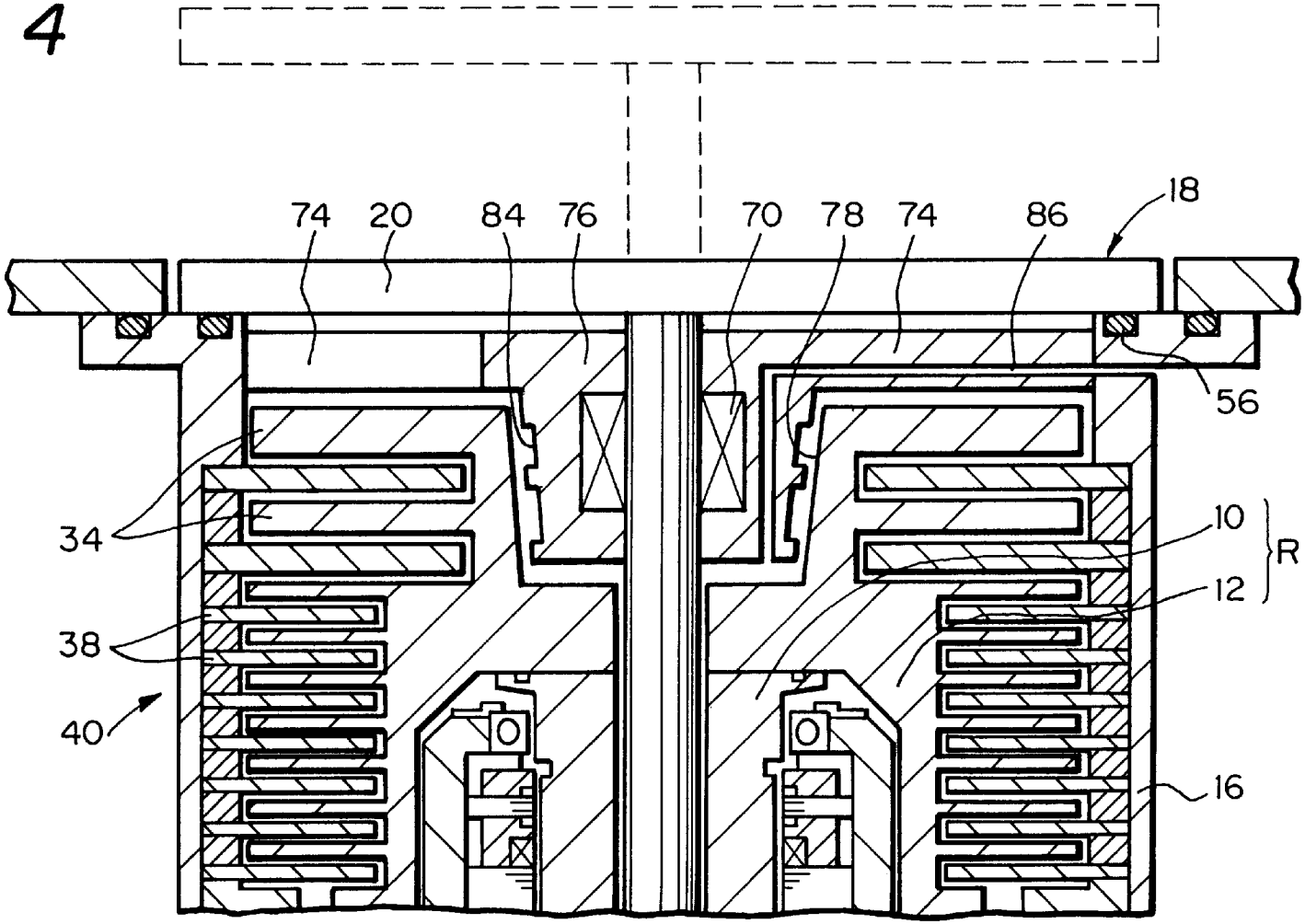
FIG. 4 is an enlarged sectional view illustrating a main portion of a turbomolecular pump shown in FIG. 3.

The valve body is opened or closed by the operation of the actuator 54, and conductance can be adjusted by adjusting opening of the valve body 20 or opening it to prescribed positions. The turbomolecular pump can directly be attached to a duct 58 or the like of an apparatus to be evacuated without interposing a valve unit therebetween as shown in FIG. 4. Because the actuator 54 drives the valve body 20 for opening/closing it in the axial direction of the main shaft of the rotor or a turbomolecular pump, the structure of axial the valve unit and the driving mechanism can largely be simplified. It is therefore possible to provide a compact turbomolecular pump as a whole, and to effectively utilize a narrow space such as a clean room.

Figure 2:
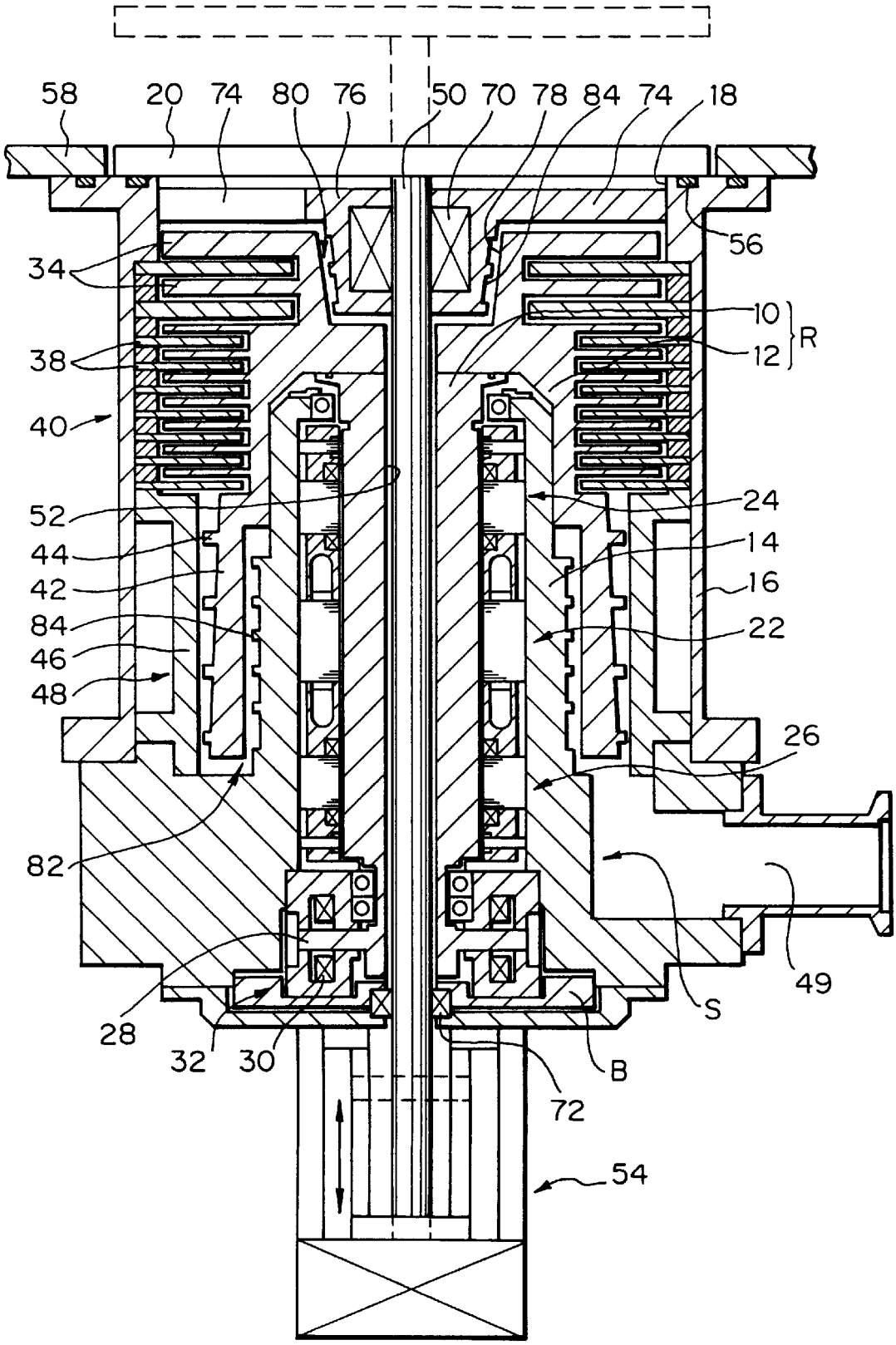
FIG. 2 is a sectional view illustrating a turbomolecular pump according to a second embodiment of the invention.

FIG. 2 illustrates a second embodiment of the present invention, wherein screw thread sealing portions 80 and 82 are formed between the outer surface of the supporting member 76 and the inner surface of the upper recess 78 in the rotary cylinder, and between the inner surface of the screw thread portion 42 of the rotary cylinder 12 and the outer surface of the stationary cylinder 14. These screw thread sealing portions 80 and 82 serve to prevent a gas from entering the central throughhole 52 and a space between the rotary cylinder 12 and the stationary cylinder 14 upon rotation of the rotor R.

More specifically, a screw thread 84 is formed on the outer surface of the supporting member 76, so that the gas is exhausted from bottom to top in FIG. 2, upon rotation of the rotor R. This prevents a gas from the suction port 18 from entering the throughhole 52 and reaching the lower end portion of the rotor R via the throughhole 52. Even when exhausting a corrosive gas, therefore, it is possible to prevent corrosion of the magnetic bearings 70 and 72, 24, 26 and 32 and the driving motor 22 provided there.

Similarly, a screw thread 84 is formed on the outer surface of the stationary cylinder 14, so that the gas is exhausted from top to bottom in FIG. 2, in the lower screw thread sealing portion 82 upon rotation of the rotor R. This prevents the gas from the discharge port 49 from entering the space between the rotary cylinder 12 and the stationary cylinder 14 and reaching the magnetic bearings 24, 26, 32 and the driving motor 22. While two screw thread sealing portions 82 and 84 are formed in this embodiment, only one of these screw thread sealing portions may be adopted as required.

Figure 3:
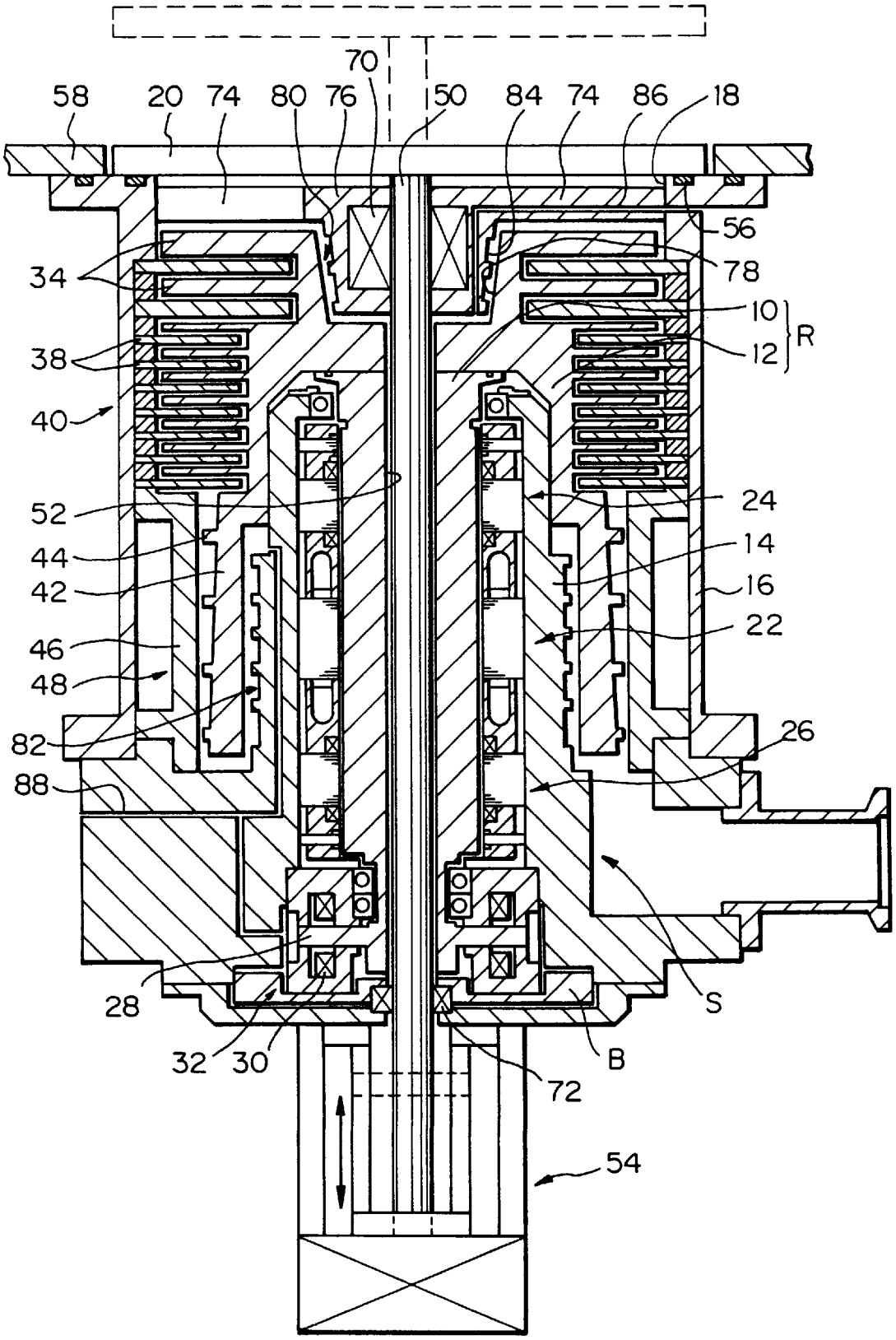
FIG. 3 is a sectional view illustrating a turbomolecular pump according to a third embodiment of the invention.

FIG. 3 illustrates a third embodiment of the present invention. In this embodiment, purge gas feeding channels 86 and 88 are formed for preventing a corrosive gas from passing through the throughhole 52 and corroding the magnetic bearings 24, 26 and 32, or the driving motor 22 of the turbomolecular pump. More particularly, the first feeding channel 86 extends from the casing 16 near the suction port 18 toward the supporting member 76 through the interior of the arm 74 and runs down the support member 76 to open at the lower surface of the supporting member 76 as shown in FIG. 4. The second feeding channel 88 extends inwardly from the lower side surface of the stator S and, on the one hand, extends up through the stationary cylinder 14 to open at the top of the screw thread sealing portion 82 and extends down through the stator S to open at the axial bearing 32 on the other hand. Although the former opening is provided at the top of the screw thread sealing portion 82 in this embodiment, it may be provided at the middle or at the bottom of the screw thread sealing portion 82. Also, the magnetic bearings 24, 26 and the motor 22, may be directly purged. Further, the number of openings may be either single or plural. An inert gas supply piping, such as nitrogen gas or the like, is connected to the openings on the outer surfaces of these feeding channels 86 and 88.

In this embodiment, it is possible to positively prevent a corrosive exhaust gas from flowing into the magnetic bearings 24, 26 and 32 or the driving motor 22 by supplying a purge gas or an inert gas into the paths leading from the suction port 18 or the discharge port 49 to the magnetic bearings 24, 26 and 32 or the motor 22, assisted by the action of the aforementioned screw thread sealing portions 80 and 82. While both the purge gas feeding channels 86 and 88 and the screw thread sealing portions 80 and 82 are provided in this embodiment, a purge gas feeding channels 86 and 88 alone may be provided. Further a purge gas feeding channel 86 or 88 alone may be provided.

Figure 5:
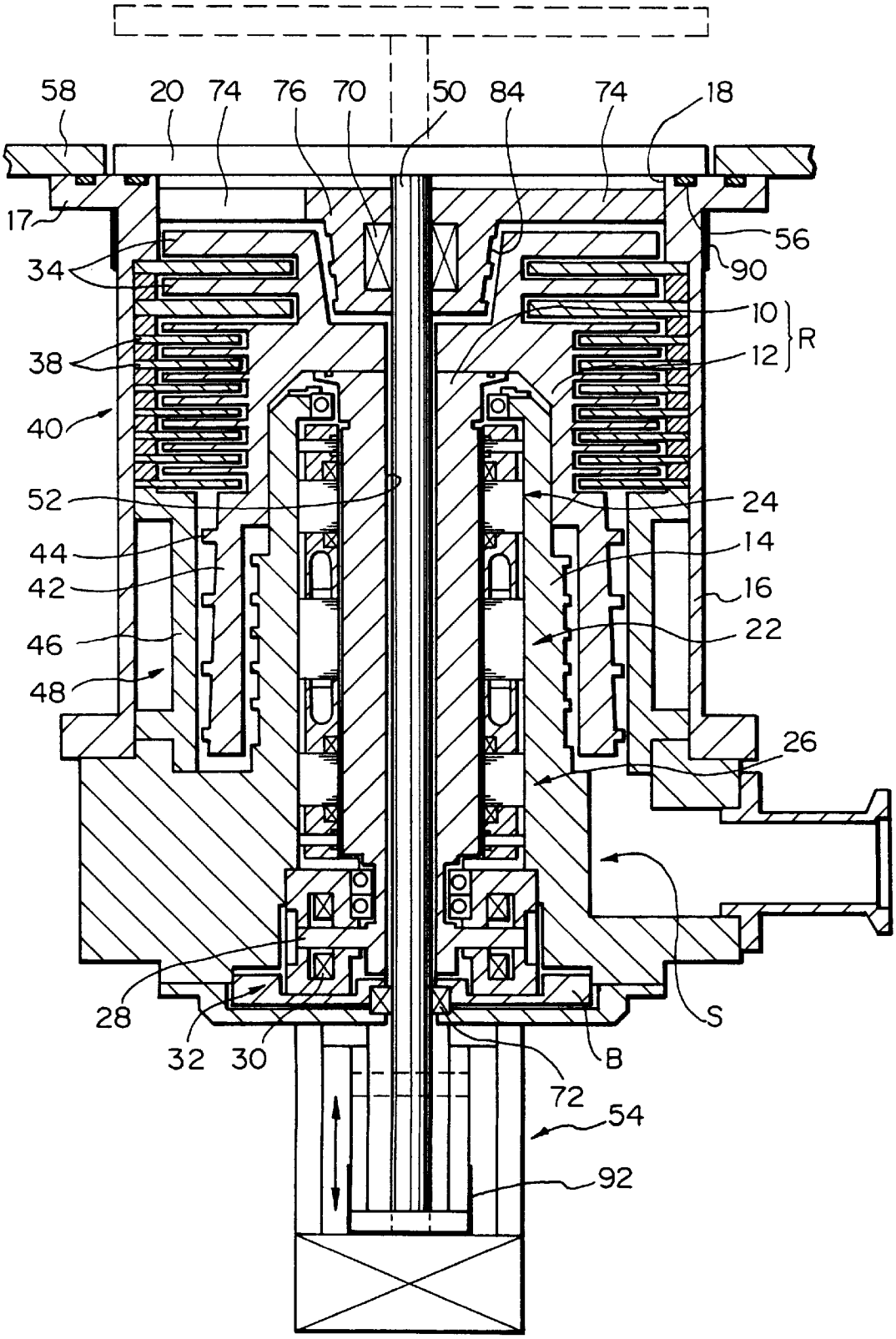
FIG. 5 is a sectional view illustrating a turbomolecular pump according to a fourth embodiment of the invention.
Figure 6:
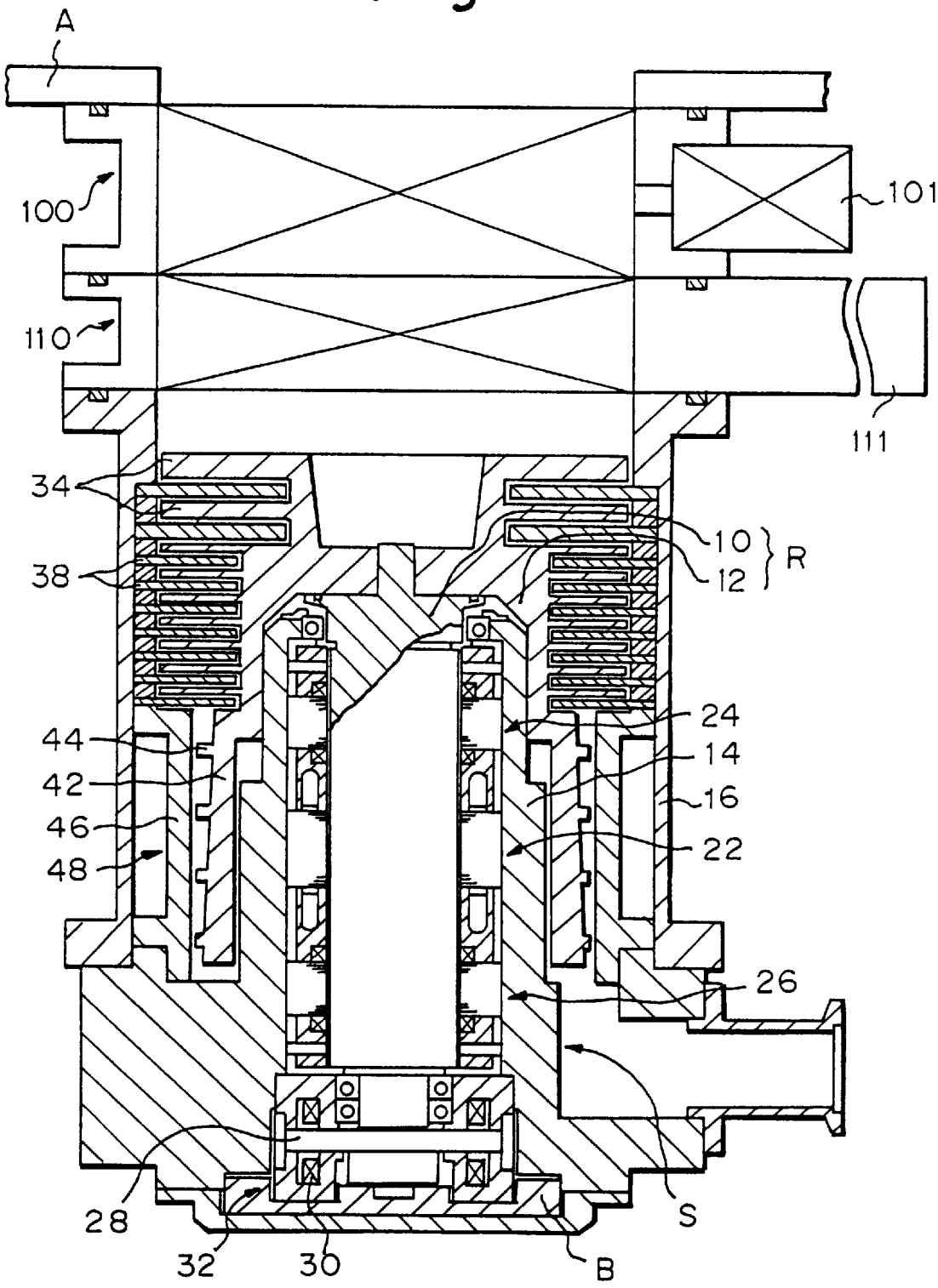
Fig. 6 PRIOR ART
FIG. 6 is a sectional view illustrating a conventional turbomolecular pump.

FIG. 5 illustrates a fourth embodiment of the present invention, wherein gas deposit preventing means is provided to prevent deposit of gas components on the contact portion between the valve body 20 and the suction port 18 so as to ensure positive sealing of the suction port 18 by the valve body 20. More specifically, a heater 90 for heating the contact surfaces is provided on the casing 16 near the suction port 18. While an electric heater is adopted in this embodiment, any appropriate heater, e.g. supplying of a hot air or water, may be adopted. In this embodiment, the casing 16 and the flange 17 are heated by the operation of the heater 90, thus preventing the components of the exhaust gas from being deposited in this area, or inhibiting such deposition.

In this embodiment, a heater 92 for heating the valve rod is further provided at a prescribed position of the actuator 54 of the valve driving unit. As a result, heat from the heater 92 is transmitted to the valve body 20 via the valve rod 50, and further from the center to the edge of the valve body 20, thus keeping the contact portion between the valve body 20 and the flange 17 at a prescribed temperature. This prevents components of the exhaust gas from being deposited at this portion, thus keeping stable or positive opening/closing operations of the valve body.

Although, in the illustrated embodiments, a throughhole for receiving the valve body supporting rod is formed in the rotor, it is possible to form the throughhole in the stator or in the stator and the rotor when the main shaft is provided as a stationary member at the center of the turbomolecular pump and the rotor is provided around the main shaft.

According to the present invention, as described above, it is possible to form the entire apparatus including the valve unit into a compact construction by integrally forming the valve unit and the turbomolecular pump. Also, it is possible to prevent contamination caused by particles arising from the supporting mechanism and to stably support the valve body by supporting and driving the rotor without contact. Thus, it is possible to provide a highly practicable turbomolecular pump which permits effective use of a small space such as a clean room.

What is claimed is:

1. A turbomolecular pump, comprising:

a rotor housed in a casing;

a stator housed in said casing, said rotor and said stator forming a gas exhaust channel therebetween;

a suction port formed in said casing;

an exhaust port formed at the outer peripheral portion of said stator;

a valve body for opening and closing said suction port, wherein said valve body is movable in an axial direction of said casing;

a valve body supporting rod having an upper portion connected to said valve body, said valve body supporting rod extending through a throughhole formed in said rotor and/or said stator;

a valve body driving mechanism for driving said valve body via said valve body supporting rod; and magnetic bearing units for non-contactingly supporting said valve body supporting rod within said throughhole, wherein said valve body driving mechanism includes an actuator provided at a lower portion of said casing and connected to a lower portion of said valve body supporting rod.

2. The turbomolecular pump according to claim 1, wherein said magnetic bearing units include a pair of upper and lower magnetic bearings, and wherein said upper magnetic bearing is supported by a support member provided at a center portion of said suction port and said lower magnetic bearing is provided on a base of said casing.

3. The turbomolecular pump according to claim 2, wherein said support member is accommodated in a recess formed on a top surface of said rotor at a center thereof.

4. The turbomolecular pump according to claim 1, wherein said rotor is non-contactingly supported by a rotor magnetic bearing provided between said rotor and said stator, and a screw thread sealing mechanism is provided between said rotor and said stator for inhibiting a gas flow into said rotor magnetic bearing.

5. The turbomolecular pump according to claim 3, wherein said rotor is non-contactingly supported by a rotor magnetic bearing provided between said rotor and said stator, wherein a screw thread sealing mechanism is provided between said rotor and said stator for inhabiting a gas flow into said rotor magnetic bearing, wherein said screw thread sealing mechanism includes a screw thread sealing portion formed between an outer surface of said support member and an inner surface of said recess and/or a screw thread sealing portion formed between an inner surface of said screw thread sealing portion of said rotor and an outer surface of said stator.

6. The turbomolecular pump according to claim 1, wherein a gas feeding channel for feeding an inert gas is provided at a prescribed position between said rotor and said stator for inhibiting a gas flow into said bearing units by said inert gas.

7. The turbomolecular pump according to claim 5, wherein a gas feeding channel for feeding an inert gas is provided at a prescribed position between said rotor and said stator for inhibiting a gas flow into said bearing units by said inert gas, wherein said gas feeding channel includes a first feeding channel extending inwardly from said casing near said suction port toward said support member and open at a lower surface of said support member and/or a second feeding channel extending inwardly from a lower side surface of said stator and open at said screw thread sealing portion.

8. The turbomolecular pump according to claim 1, further comprising gas deposition preventing means provided near said suction port for preventing deposition of gas components at a contact portion between said suction port and said valve body by heating said suction port and/or said valve body.

9. The turbomolecular pump according to claim 8, wherein said gas deposition preventing means comprises a heater provided on said casing near said suction port.

10. The turbomolecular pump according to claim 9, wherein said gas deposition preventing means further includes a heater provided at a prescribed position of said valve body driving mechanism for heating said valve body supporting member.

* * * * *